US007011547B1

(12) United States Patent
Wu

(10) Patent No.: US 7,011,547 B1
(45) Date of Patent: Mar. 14, 2006

(54) CONNECTOR OF COAXIAL CABLES

(75) Inventor: Ernest Wu, Tainan (TW)

(73) Assignee: Golden Loch Industrial Co., Ltd., Tainan (TW)

( * ) Notice: Subject to any disclaimer, the term of this patent is extended or adjusted under 35 U.S.C. 154(b) by 0 days.

(21) Appl. No.: 10/991,411

(22) Filed: Nov. 19, 2004

(51) Int. Cl.
*H01R 9/05* (2006.01)

(52) U.S. Cl. ..... 439/584; 439/583

(58) Field of Classification Search ..... 439/584, 439/583, 578, 585, 582
See application file for complete search history.

(56) References Cited

U.S. PATENT DOCUMENTS 4,575,274 A * 3/1986 Hayward ..... 403/2
5,651,698 A * 7/1997 Locati et al. ..... 439/578
5,863,220 A * 1/1999 Holliday ..... 439/584
6,830,479 B1 * 12/2004 Holliday ..... 439/585

* cited by examiner

*Primary Examiner*—Ross Gushi
(74) *Attorney, Agent, or Firm*—Rosenberg, Klein & Lee

(57) ABSTRACT

A connector for a coaxial cable includes a fastening sleeve received in a tubular end piece and the cable extends through the fastening sleeve. The fastening sleeve includes a tapered inner periphery. A threaded piece is threadedly connected to the end piece and includes a tapered inner periphery which presses a thinner portion at the tapered inner periphery of the fastening sleeve so as to apply an inward force to the fastening sleeve to secure the cable without using any special tool. A tube securely extends through the threaded piece and the core of the cable extends through the tube. A connection collar is rotatably mounted to the tube and has a connection threaded portion which is used to connect with a jack of an electric appliance.

2 Claims, 5 Drawing Sheets

CONNECTOR OF COAXIAL CABLES

FIELD OF THE INVENTION

The present invention relates to a connector of coaxial cable that uses a fastening sleeve to fasten and position the cable without using special tools.

BACKGROUND OF THE INVENTION

A conventional connector for coaxial cables generally includes a collar which is securely mounted to the cable by using special tools and the copper core or wire of the cable is extended in the tubular portion of the collar so as to be electrically connected to a jacket of electric appliances. It is noted that it takes a lot of time to secure the collar to the cable and the assemblers have to carefully control the force that is applied to the collar so as not to damage the copper core or wire.

The present invention intends to provide a connector for an axial cable wherein the cable is easily connected to the collar by using a fastening sleeve which is squeezed by the cooperation of an end piece and a threaded piece so that the assemblers need no special tools to assemble the connectors.

SUMMARY OF THE INVENTION

The present invention relates to a connector for a coaxial cable and the connector comprises a tubular end piece and a fastening sleeve is received in the end piece so as to receive a cable. The fastening sleeve includes a tapered outer periphery. A threaded piece is threadedly connected to the end piece and a tapered inner periphery is defined in an inner periphery of the threaded piece so as to press a thinner portion of the tapered outer periphery and to apply an inward force to the fastening sleeve to secure the cable. A tube has a first end securely extending through the threaded piece and receives a core of the cable. A connection collar is rotatably mounted to the tube and has a connection threaded portion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
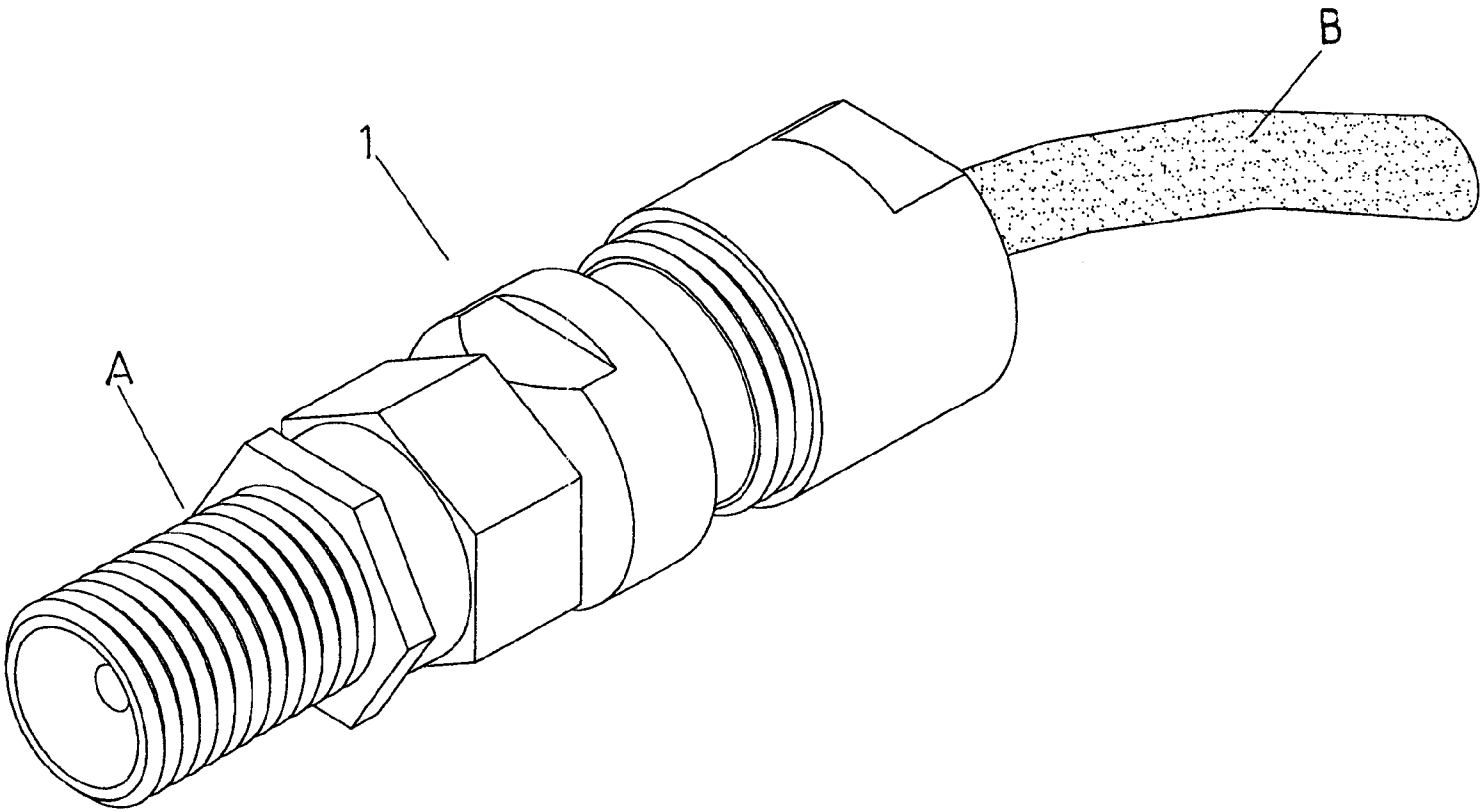
FIG. 1 shows the connector of the present invention is connected to a jack of an electric appliance.
Figure 2:
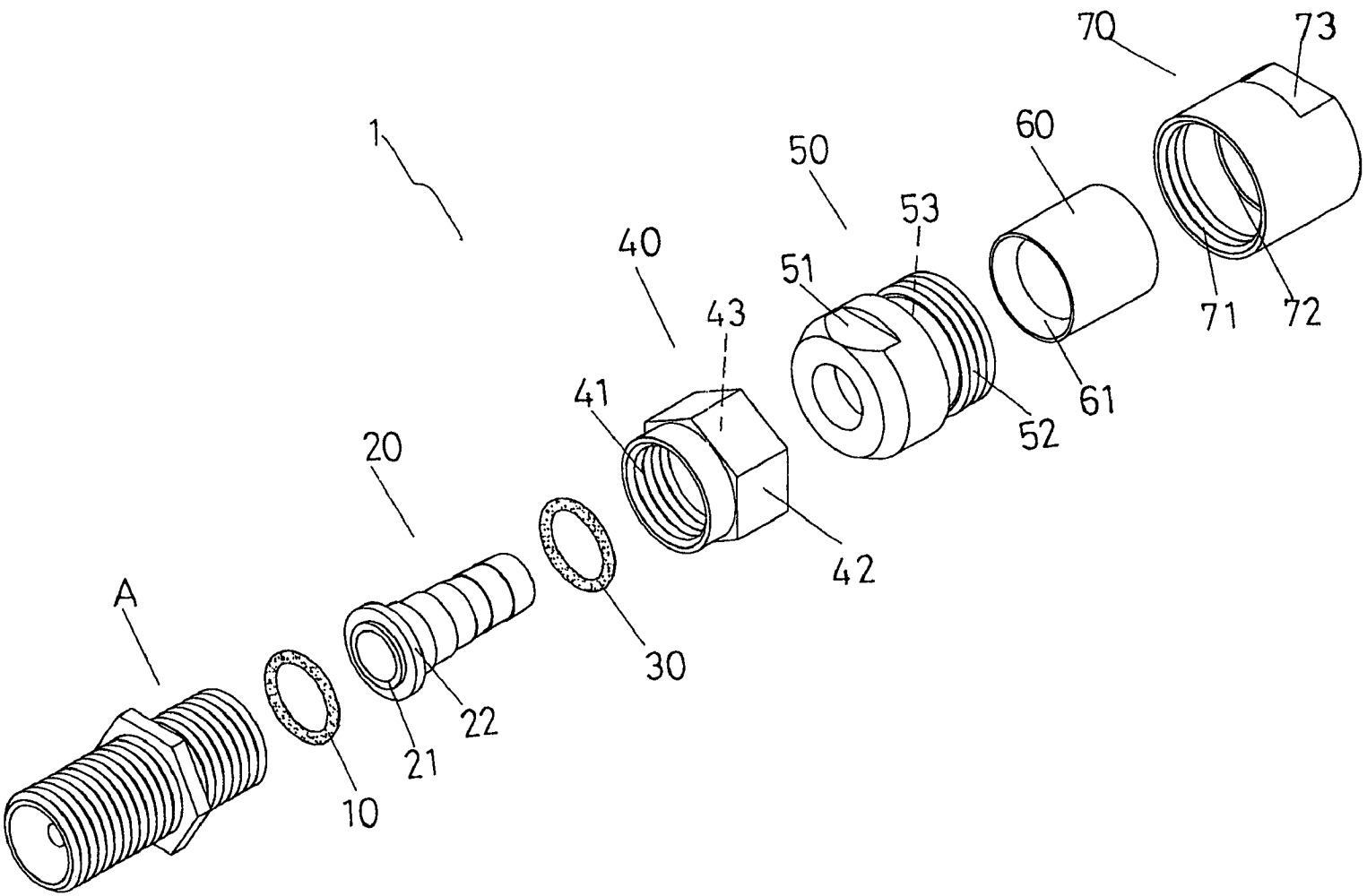
FIG. 2 is an exploded view to show the connector of the present invention.
Figure 3:
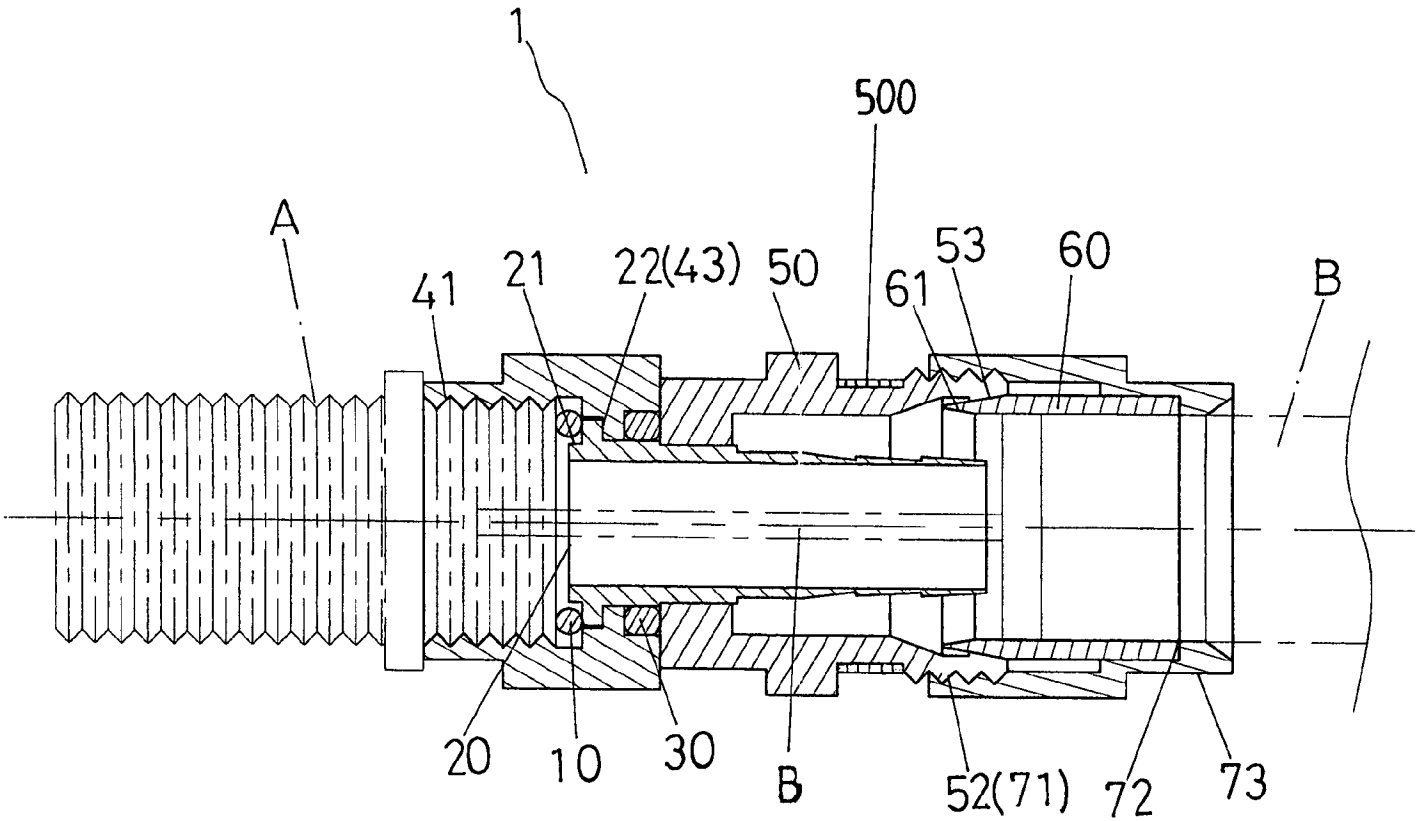
FIG. 3 is a cross sectional view to show the connector of the present invention.

Referring to FIGS. 1 to 3, the connector 1 of the present invention comprises a tubular end piece 70 that includes two first flat surfaces 73 defined in an outer periphery thereof and a fastening sleeve 60 is received in the end piece 70. An inner threaded portion 71 is defined in an inner periphery of the end piece 70 and a shoulder 72 is defined in the inner periphery of the end piece 70. An end of the fastening sleeve

60 is in contact with the shoulder 72. The fastening sleeve 60 receives a cable "B" and includes a tapered inner periphery 61 at the other end thereof.

A threaded piece 50 includes an outer threaded portion 53 defined in an outer periphery thereof and a tapered inner periphery 53 is defined in an inner periphery of the threaded piece 50. The threaded piece 50 includes two second flat surfaces 51 defined in an outer periphery thereof. The outer threaded portion 53 of the threaded piece 50 is threadedly engaged with the inner threaded portion 71 of the end piece 70, and the tapered inner periphery 53 of the threaded piece 50 presses the thinner portion of the tapered inner periphery 61 so as to apply an inward force to squeeze the second end of the fastening sleeve 60 to secure the cable "B".

A tube 20 has a first end securely extending through the threaded piece 50 and a core "B1" of the cable "B" extends through the tube 20. A connection collar 40 is rotatably mounted to the tube 20 and has a connection threaded portion 41 which is threadedly connected to a jack "A" of electric appliance. The connection collar 40 includes a flange 43 extending from the inner periphery thereof and the tube 20 includes a lip 22 extending from an outer periphery thereof. The lip 22 is rotatably engaged with the flange 43 so that the connection collar 40 is not disengaged from the tube 20. A first seal 30 is mounted to the tube 20 and sandwiched between the flange 43 of the threaded piece 40 and an end face of the threaded piece 50. The tube 20 further includes an annular protrusion 21 extending from a second end thereof and a second seal 10 is mounted to the annular protrusion 21.

Figure 4:
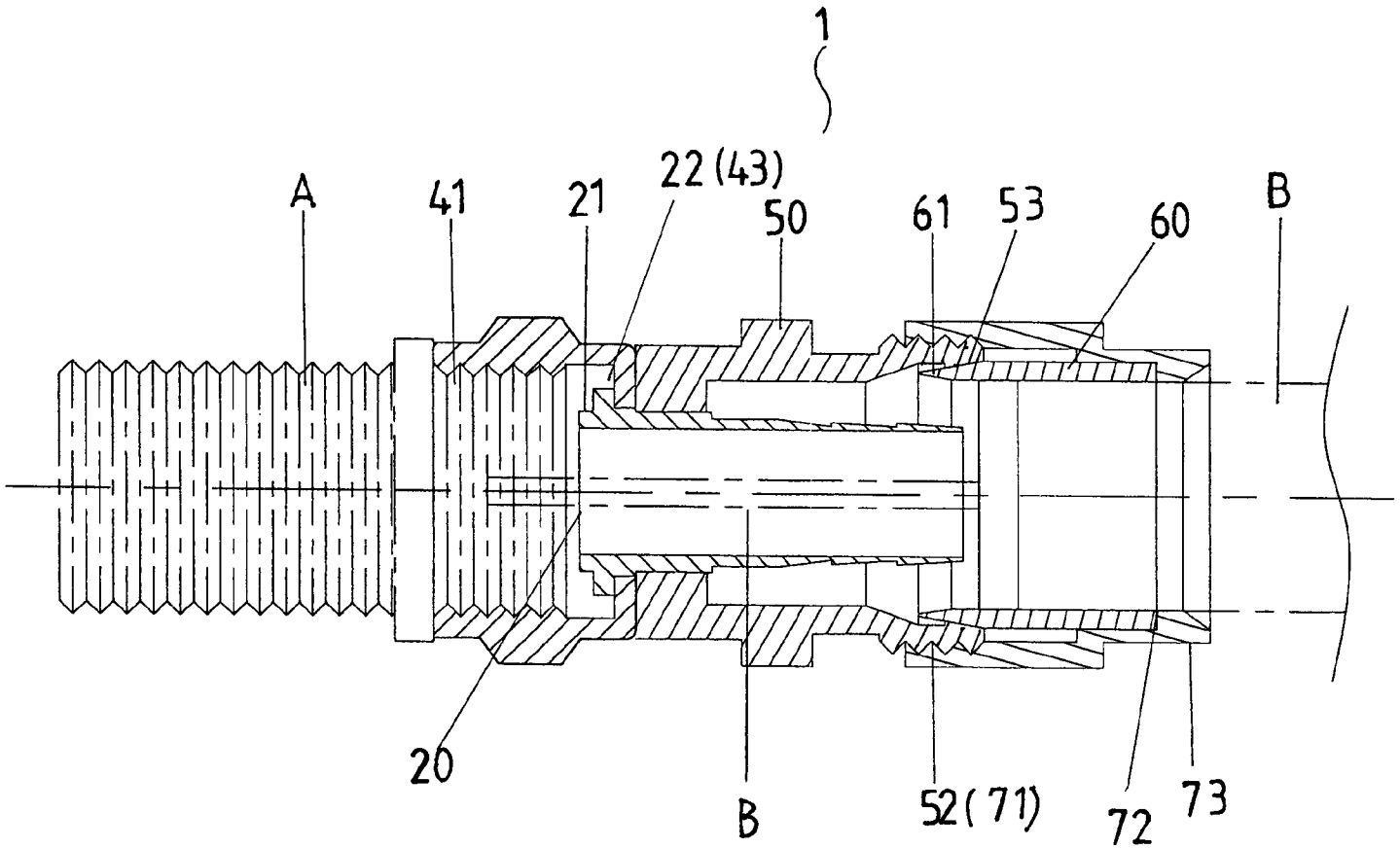
FIG. 4 is a cross sectional view to show another embodiment of the connector of the present invention.

It is noted that the assemblers need no special tools to secure the cable "B" which is conveniently secured by rotating the threaded part 50 relative to the end piece 70. The assembler can clamp the first flat surfaces 73 by one hand and uses another tool to clamp and rotate the second flat surfaces 51 to easily secure the cable "B". An identification ring 500 as shown in FIG. 3 can be mounted to the threaded piece 50 to identify the types of the cables "B". FIG. 4 shows that the two seals 10, 30 can also be omitted for the connector 1.

Figure 5:
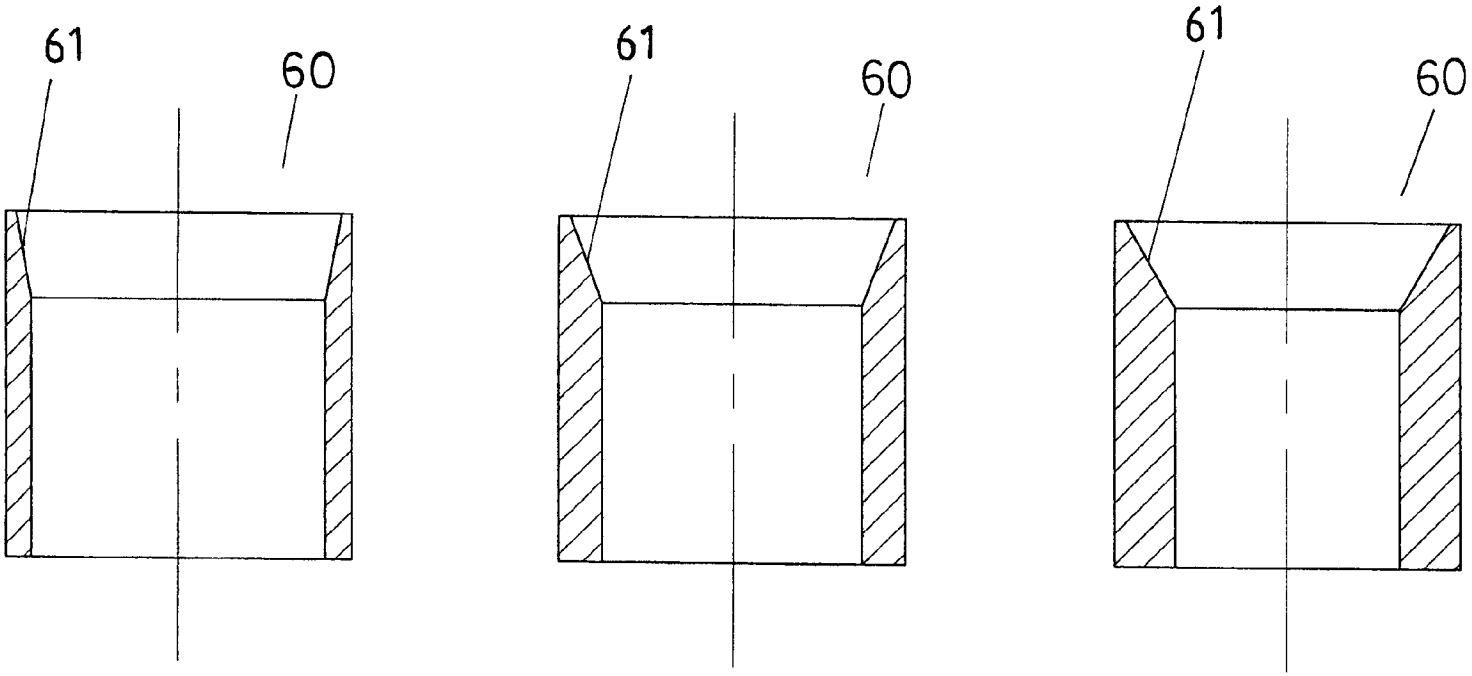
FIG. 5 shows the fastening sleeves with different sizes.

FIG. 5 shows that the fastening sleeves 60 can be different sizes so as to secure the cables "B" of different sizes.

While we have shown and described the embodiment in accordance with the present invention, it should be clear to those skilled in the art that further embodiments may be made without departing from the scope of the present invention.

What is claimed is:

1. A connector for a coaxial cable which includes a core, comprising:

a tubular end piece having an inner threaded portion defined in an inner periphery thereof, the end piece having a shoulder formed in the inner periphery thereof;

a fastening sleeve received in the end piece and having an end thereof in contact with the shoulder, the fastening sleeve being adapted to receive a cable and including a tapered inner periphery;

a threaded piece having an outer threaded portion defined on an outer periphery thereof, a tapered inner periphery being defined in an inner periphery of the threaded piece, the outer threaded portion of the threaded piece threadedly engaged with the inner threaded portion of the end piece, the tapered inner periphery of the threaded piece pressing a thinner portion at the tapered inner periphery of the fastening sleeve so as to apply an inward force to the fastening sleeve;

a tube having a first end securely extending through the threaded piece and adapted to receive a core of the cable, the tube having a lip extending from an outer periphery thereof at a second end of the tube and an annular protrusion extending from the second end; and a connection collar rotatably mounted to the tube and having a connection threaded portion, the connection collar including a flange extending from an inner periphery thereof and the lip of the tube being rotatably engaged with the flange;

a first seal mounted to the tube and sandwiched between the flange of the connection collar and an end face of the threaded piece; and, a second seal mounted to the annular protrusion of the tube for sealing against a jack engaged with the connection threaded portion of the connection collar.

2. The connector as claimed in claim 1, wherein the end piece includes two first flat surfaces defined in an outer periphery thereof and the threaded piece includes two second flat surfaces defined in an outer periphery thereof.

* * * * *